US005499489A

United States Patent [19]

Perobelli et al.

[11] Patent Number: 5,499,489

[45] Date of Patent: Mar. 19, 1996

[54] MACHINE FOR MAKING BUNDLES OF WRAPPED SHEETS

[75] Inventors: Aldo Perobelli; Giorgio Pessina, both of Cusano Milanino, Italy

[73] Assignee: O.M.G. di Giorgio Pessina e Aldo Perobelli S.n.c., Milan, Italy

[21] Appl. No.: 413,883

[22] Filed: Mar. 30, 1995

[30] Foreign Application Priority Data

Jun. 2, 1994 [IT] Italy ..... MI94A1154

[51] Int. Cl.[6] ..... B65B 11/00

[52] U.S. Cl. ..... 53/540; 53/589; 53/529; 53/582

[58] Field of Search ..... 53/447, 540, 582, 53/589, 496, 529, 135.2; 414/788.9, 790, 790.1, 790.3, 790.8

[56] References Cited

U.S. PATENT DOCUMENTS

| | | | |
|---|---|---|---|
| 2,672,079 | 3/1954 | Chandler . | |
| 3,095,678 | 7/1963 | Cliff et al. | 53/529 |
| 3,507,088 | 4/1970 | Mizelle et al. | 53/135.2 |
| 3,570,209 | 3/1971 | Salwasser | 53/540 |
| 3,579,944 | 5/1971 | Heywood et al. . | |
| 3,585,777 | 6/1971 | Pesch | 53/540 |
| 4,094,130 | 6/1978 | Kelly et al. | 53/529 |
| 4,141,193 | 2/1979 | Joa | 53/529 |
| 4,162,603 | 7/1979 | Stromberg | 53/529 |
| 4,481,751 | 11/1984 | Ujhely . | |
| 4,492,070 | 1/1985 | Morse et al. | 53/447 |
| 4,802,808 | 2/1989 | Wolk et al. | 414/790.3 |

*Primary Examiner*—John Sipos
*Assistant Examiner*—Ed Tola
*Attorney, Agent, or Firm*—Stevens, Davis, Miller & Mosher

[57] ABSTRACT

A machine for making bundles (3) of sheets (2), in particular signatures, wrapped by means of a wrapping machine (15), including: a first pusher (7) which moves said bundles (3) in the direction (A) against a stop (10); means (17, 20) suitable to keep the bundle (3) pushed against the stop (10) when the first pusher (7) moves away from the bundle (3) to return in the rear position; and a second pusher (13) which moves the bundle (3) in the direction (B) perpendicular to the groove (16) in which the wrapper of the wrapping machine (15) arranged side by side with the machine is housed.

13 Claims, 2 Drawing Sheets

MACHINE FOR MAKING BUNDLES OF WRAPPED SHEETS

BACKGROUND OF THE INVENTION

The present invention relates to a machine for making bundles of sheets, in particular signatures, wrapped by means of a wrapping machine.

SUMMARY OF THE INVENTION

The object of the present invention is to provide a machine, for making bundles of wrapped sheets, having the following characteristics:

- the bundles of sheets are always kept guided, so that when the bundles are pushed towards the wrapping machine they can freely slide without tripping and therefore without breaking up;
- one or more parallel wrappings can be effected on each bundle by means of a single wrapping machine;
- the bundle is correctly positioned at the wrapping machine without interfering with the wrapper by tearing it or by sticking into the wrapper guiding groove.

These characteristics are all achieved by the present invention, characteristics which are pointed out in the enclosed claims and in the following detailed description of the machine including three preferred but non-limiting embodiments of the machine, illustrated for merely exemplificative and non-limitative purposes, in the annexed drawings.

DETAILED DESCRIPTION OF THE PREFERRED EMBODIMENTS

Figure 2:
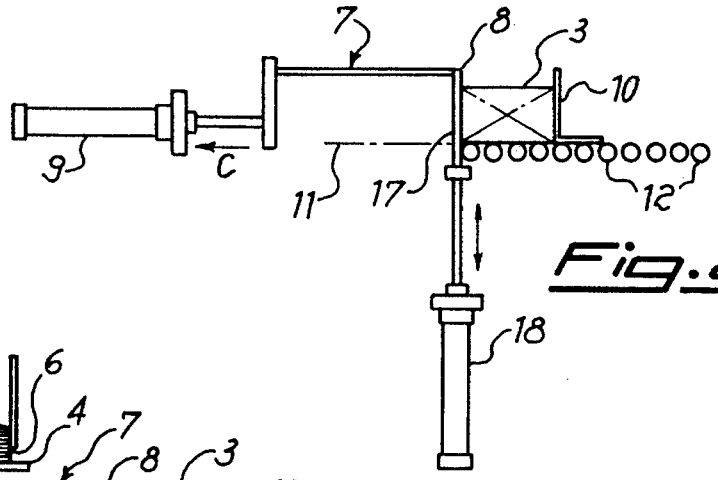
FIG. 2 is a schematic side view of the machine, in a second step of the operating cycle.

The present machine generically includes means for transporting said sheets, for making subsequent bundles of sheets and for positioning said bundles at a wrapping machine.

With reference to the enclosed drawings, said means are defined in the following way, as an example:

said transporting means consist in a feeder 1 of the sheets 2 and similarly the means for making the bundles 3 of sheets 2 consist in a support 4 which is progressively lowered by a piston 5 as the forming bundle 6 of sheets 2 grows, until support 4, consisting in horizontal bars, goes below a first pusher 7 shaped as a rack made up of horizontal and vertical bars 8. The bars of support 4 pass through bars 8 of support 7 while lowering, whereby the incoming sheets are laid on the upper surface of pusher 7, which during the backstroke to its rearmost position, by means of piston 9, lays down a portion of the forming bundle 6 on support 4 which progressively lowers until it reaches the plane 11 of rollers 12, prior to the shifting of bundle 3 towards stop 10 in the direction of arrow A. As it may be seen in FIG. 1, which is an intermediate position of the cycle, the forming bundle 6 of sheets is formed on support 4 while piston 9, through pusher 7, pushes the previously formed bundle 3 against stop 10, reaching the position of FIG. 2.

Figure 1:
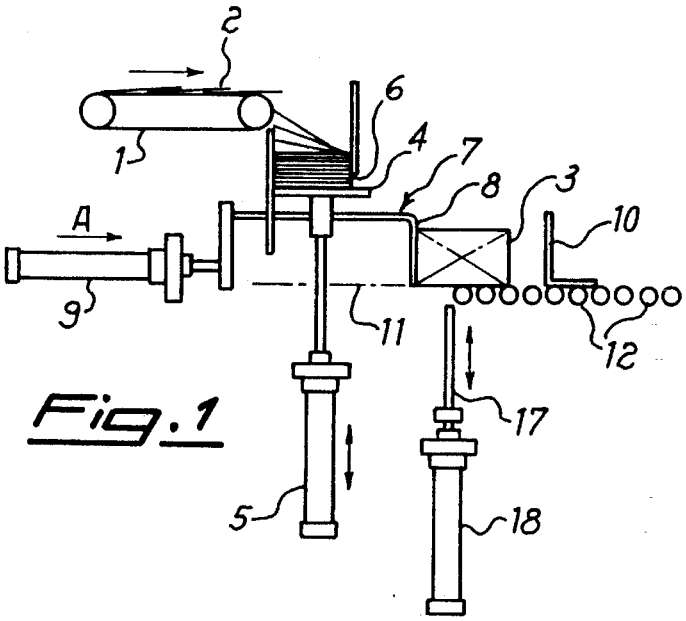
FIG. 1 is a schematic side view of the machine, in an intermediate step of the operating cycle.
Figure 5:
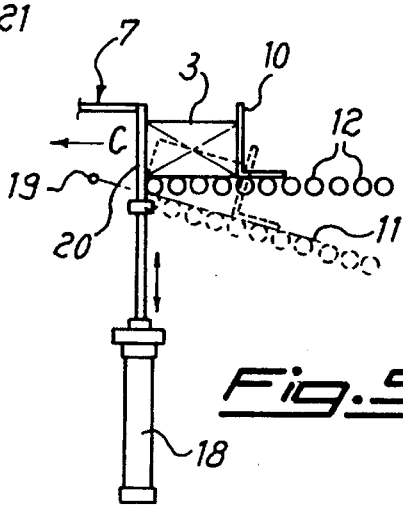
FIG. 5 is a second embodiment alternative to the embodiment illustrated in the preceding figures.

Support 4 returns from the lower position to the upper position of FIG. 1 by means of FIG. 5, in order to collect other sheets coming in from feeder 1 when pusher 7 moves from the position of FIG. 2 to the rearmost position.

The means for transporting said sheets and the means suitable for making subsequent bundles of sheets could be arranged even in a manner different from the one described above and given as a mere example.

Figure 3:
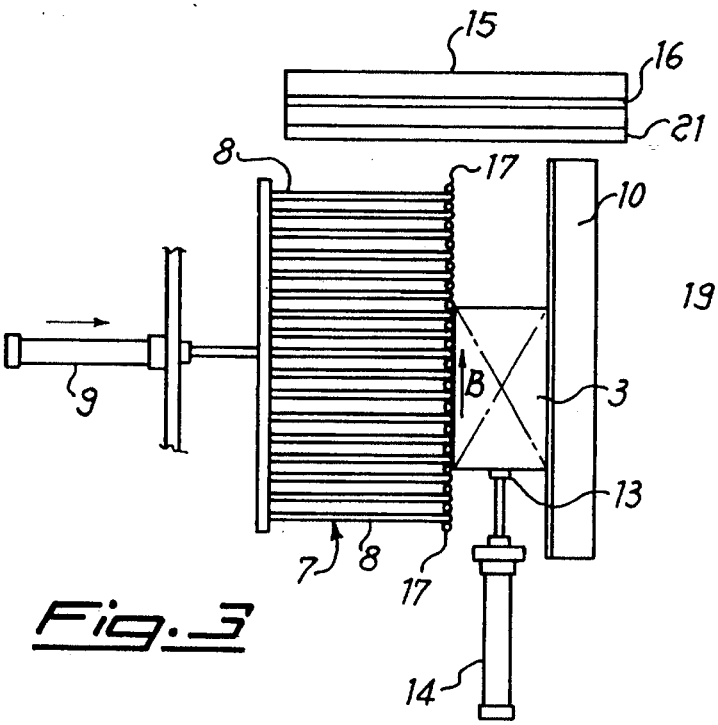
FIG. 3 is a schematic plan view of the machine, in the step of the operating cycle of FIG. 2.
Figure 8:
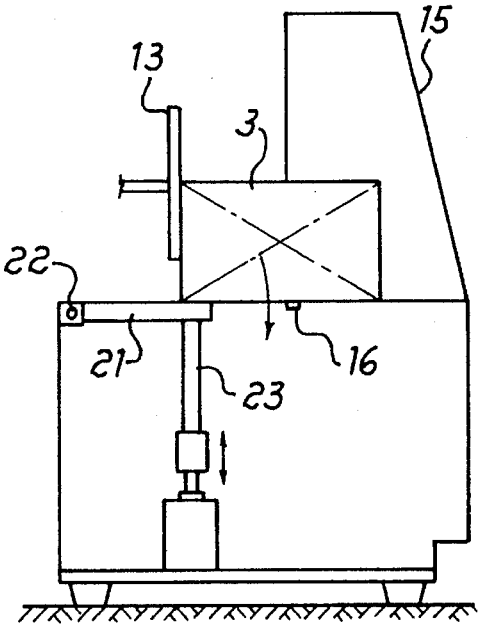
FIG. 8 is a schematic side view of the wrapping machine with the bundle in the wrapping position.
Figure 9:
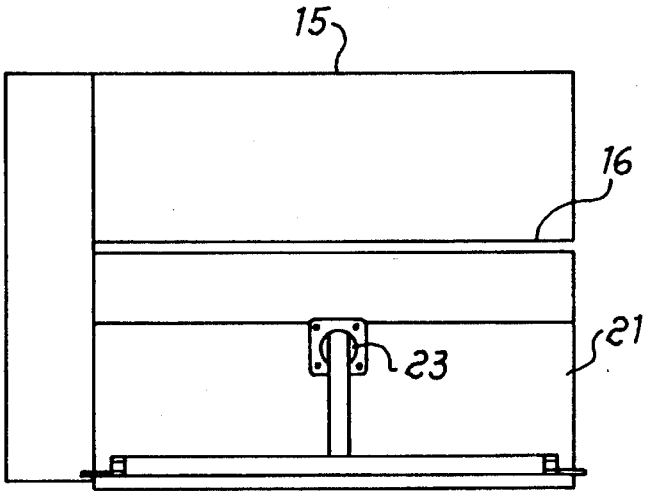
FIG. 9 is a plan view of the wrapping machine.

A second pusher 13 is provided, which pushes each bundle 3 by means of a piston 14 in the direction of arrow B, as in FIG. 3, perpendicular to arrow A until it is positioned at a wrapping machine 15 arranged side by side with the machine, as shown in FIG. 8, in a position suitable for wrapping bundle 3 with a wrapper placed in groove 16 of the wrapping machine 15, so as to wrap the bundle with the wrapper transversely with respect to the direction of motion of said second pusher 13.

Pusher 13 is stopped in multiple positions during its travel for shifting bundle 3 towards the wrapping machine 15, in order to wrap the bundle with multiple wrappers.

A further characteristic of the present invention is the provision of means suitable to keep the bundle pushed against said stop 10 even when the first pusher 7 moves away from the bundle to return in the rear position suitable to move subsequently a new bundle in the position against stop 10, as shown in FIG. 2.

Figure 4:
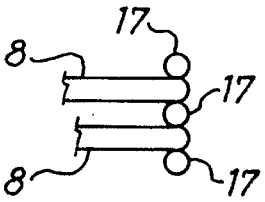
FIG. 4 shows an enlarged detail of FIG. 3.

In a first embodiment, said means suitable to keep the bundle of sheets against said stop 10 consist in a series of cylindrical or rounded pegs 17, vertically pushed by a piston 18 as shown in FIGS. 3 and 4, passing through the vertical bars 8 of the first pusher 7 so as to fill the spaces therebetween and thus achieve the free sliding of bundle 3, pushed by the second pusher 13 towards the wrapping machine 15, along said pegs 17 while keeping the bundle pushed against the stop wall 10 when pusher 7 returns to its rearmost position, according to arrow C.

A second embodiment of the means suitable to keep the bundle pushed against said stop 10 is illustrated in FIG. 5, according to which the horizontal plane 11 formed by rollers 12, on which the bundle of sheets arrives, is inclined around a pivot 19 integrally with said stop 10 so that a vertical plane 20 can be raised without interfering with the bundle of sheets which is inclined integrally with said horizontal plane 11 during its inclination. Therefore, the vertical plane 20 keeps the bundle pushed against said stop 10 when the first pusher 7 moves away from the bundle to reach its rearmost position. In this way, the vertical plane 20 and stop 10 back in the vertical position form a channel along which bundle 3 is moved by said second pusher 13, after that said roller plane 11 pivoted in 19 has regained its original horizontal position from the inclined position.

Figure 6:
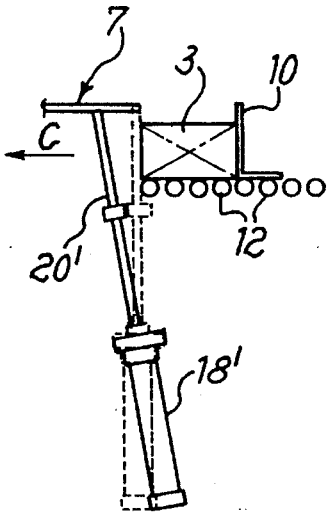
FIG. 6 is a third embodiment alternative to the preceding ones.

A third embodiment is illustrated in FIG. 6, according to which a plane 20', which may be solid or bar-shaped, is raised in an inclined position by piston 18' so as to avoid interference with bundle 3. When pusher 7 is returned according to arrow C, plane 20' resumes the dotted vertical position against bundle 3, during the shifting of bundle 3 towards the wrapping machine.

Figure 7:
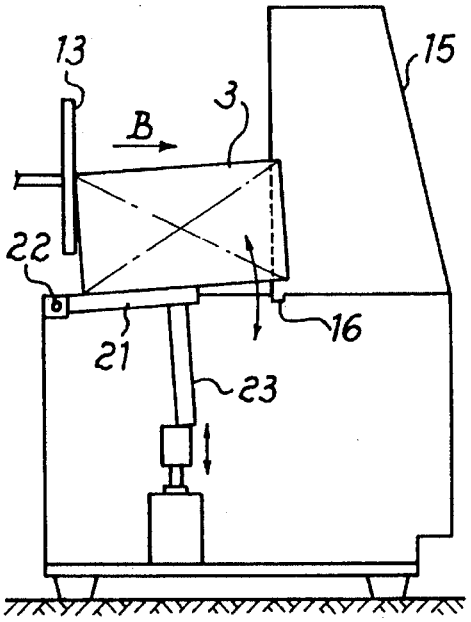
FIG. 7 is a schematic side view of the wrapping machine with the bundle in a first position.

A further feature of the machine is the provision for a plate 21 adjacent to the wrapping machine 15 and suitable to be inclined around pivot 22, by means of a piston 23, from the horizontal position to a position high on the side of the wrapping machine 15, as shown in FIG. 7. In this way, when the bundle 3 of sheets 2 is pushed by said second pusher 13 towards the wrapping machine 15, the bundle can freely slide with no hindrance and climb over groove 16, in its front portion, until the bundle is in the correct position, as shown in FIG. 8, to be wrapped by the wrapper of said wrapping machine 15 when plate 21 is taken back to the horizontal position.

The wrapping machine 15 may also be moved parallelly in different positions, so that, if required, various parallel wrappers corresponding to the different positions reached by the wrapping machine 15 can be wrapped around the bundle.

What is claimed is:

1. A machine for making bundles of sheets to be wrapped by a wrapping machine comprising: means for transporting said sheets; means for bundling said transported sheets to make bundles of said sheets; a horizontal plane on which said bundles of sheets arrive; a first pusher which moves said bundles in a first direction to against a stop, and means for positioning said bundles, at the wrapping machine, comprising a second pusher for moving each bundle in a second direction perpendicular to the first direction and to a wrapper of the wrapping machine until the bundle is positioned at the wrapping machine arranged side by side with the machine for making bundles in such a way as to wrap the bundle with the wrapper transversely with respect to the second direction of motion of said second pusher, means for keeping the bundle pushed against said stop even when the first pusher moves away from the bundle to return to the first position along a third direction and to move subsequently a new bundle, wherein the first pusher is made up of spaced vertical bars and the means for keeping said bundle pushed against said stop comprise a series of rounded pegs vertically passing through said bars so as to fill spaces therebetween and thus achieve the free sliding of the bundle, pushed by the second pusher, along said pegs towards the wrapping machine and keeping the bundle pushed against the stop.

2. A machine for making bundles according to claim 1, wherein the horizontal plane on which the bundle arrives comprises means for inclining integrally with said stop from an original horizontal position to an inclined position and the means for keeping the bundle pushed against the stop comprise a vertical plane located for raising and lowering in such a way that said vertical plane, upon raising, does not interfere with the bundle of sheets which is inclined integrally with said horizontal plane and keeps the bundle pushed against said stop when the first pusher moves away from the bundle to return to its first position, and in such a way that the vertical plane and the stop form a channel along which the bundle is moved by said second pusher after which said horizontal plane has regained its original horizontal position from the inclined position.

3. A machine for making bundles according to claim 1, wherein the means for keeping said bundle pushed against said stop comprises a plane for raising in an inclined position to avoid interference with the bundle and reaching a vertical position when the first pusher moves away from the bundle.

4. A machine for making bundles according to claim 1, wherein said machine for making bundles is provided with a plate, adjacent to the wrapping machine, having means for inclining from a horizontal position to a position high on the side of the wrapping machine, whereby when the bundle is pushed by said second pusher towards the wrapping machine, the bundle is freely slidable with no hindrance and able to climb over a groove of the wrapping machine, in its front portion, until the bundle is positioned to be wrapped by the wrapper of the wrapping machine when said plate is taken back to the horizontal position.

5. A machine for making bundles according to claim 1, comprising means for stopping the second pusher in multiple positions, whereby the bundle is able to be wrapped with multiple wrappers.

6. A system comprising said machine for making bundles according to claim 1, and the wrapping machine of claim 1, wherein said wrapping machine comprises means for moving parallelly in different positions for wrapping various parallel wrappers, corresponding to the different positions reached by said wrapping machine, around the bundle.

7. A machine for making bundles according to claim 2, wherein said machine for making bundles is provided with a plate, adjacent to the wrapping machine, having means for inclining from a horizontal position to a position high on the side of the wrapping machine, whereby when the bundle is pushed by said second pusher towards the wrapping machine, the bundle is freely slidable with no hindrance and able to climb over a groove of the wrapping machine, in its front portion, until the bundle is positioned to be wrapped by the wrapper of the wrapping machine when said plate is taken back to the horizontal position.

8. A machine for making bundles according claim 2, comprising means for stopping the second pusher in multiple positions, whereby the bundle is able to be wrapped with multiple wrappers.

9. A system comprising said machine for making bundles according to claim 2, and the wrapping machine according to claim 4, wherein said wrapping machine comprises means for moving parallelly in different positions for wrapping various parallel wrappers, corresponding to the different positions reached by said wrapping machine, around the bundle.

10. A machine for making bundles according to claim 3, wherein said machine for making bundles is provided with a plate adjacent to the wrapping machine, having means for inclining from a horizontal position to a position high on the side of the wrapping machine, whereby when the bundle is pushed by said second pusher towards the wrapping machine, the bundle is freely slidable with no hindrance and able to climb over a groove of the wrapping machine, in its front portion, until the bundle is positioned to be wrapped by the wrapper of the wrapping machine when said plate is taken back to the horizontal position.

11. A machine for making bundles according claim 5, comprising means for stopping the second pusher in multiple positions, whereby the bundle is able to be wrapped with multiple wrappers.

12. A system comprising said machine for making bundles according to claim 3, and the wrapping machine according to claim 5, wherein said wrapping machine comprises means for moving parallelly in different positions for wrapping various parallel wrappers, corresponding to the different positions reached by said wrapping machine, around the bundle.

13. The machine of claim 1, wherein the first pusher is located and dimensioned for contacting and guiding each of said bundles as each bundle moves in the first direction to against the stop.

* * * * *